US005732933A

United States Patent [19]

Champi

[11] Patent Number: 5,732,933

[45] Date of Patent: Mar. 31, 1998

[54] LIFTING IMPLEMENT

[76] Inventor: Frank Kenneth Champi, 84 Purchase St., Newburyport, Mass. 01950

[21] Appl. No.: 658,117

[22] Filed: Jul. 16, 1996

[51] Int. Cl.[6] ..... B66F 3/00

[52] U.S. Cl. ..... 254/131.5

[58] Field of Search ..... 254/131.5; 294/54.5, 294/59, 60; 248/151, 166, 432, 439, 528

[56] References Cited

U.S. PATENT DOCUMENTS

| | | | |
|---|---|---|---|
| 462,918 | 11/1891 | Zabel | 254/131.5 |
| 738,057 | 9/1903 | O'Connor | 254/131.5 |
| 1,296,738 | 3/1919 | Bekke | 254/131.5 |
| 2,269,119 | 1/1942 | Mason | 254/131.5 |
| 2,419,015 | 4/1947 | Gascoigne et al. | 254/131.5 |
| 2,769,612 | 11/1956 | Weisheit | 254/131.5 |
| 3,035,816 | 5/1962 | Conant | 254/131.5 |
| 3,119,596 | 1/1964 | Pratt | 254/131.5 |
| 4,461,458 | 7/1984 | Poulin | 254/131.5 |
| 4,531,713 | 7/1985 | Balboni | 254/131.5 |
| 4,663,995 | 5/1987 | Amundson et al. | 254/131.5 |
| 4,881,332 | 11/1989 | Evertsen | 294/59 |
| 4,991,325 | 2/1991 | Teduschi | 248/439 |

FOREIGN PATENT DOCUMENTS

| | | | |
|---|---|---|---|
| 1035983 | 4/1953 | France | 254/131.5 |
| 1122951 | 5/1956 | France | 294/60 |
| 2609612 | 9/1976 | Germany | 294/60 |

*Primary Examiner*—Robert C. Watson

[57] ABSTRACT

A lifting aid attachment for a conventional snow shovel or like tool features an elongate lever arm pivotally attached to the shovel handle, the opposite end of said lever arm terminating in a curved fork, spanned by a foot-engaging cross-bar. The curved fork serves as a fulcrum for the application of downward foot pressure by the user on the cross-bar, which combined with a rearward pull on the shovel handle enables a smooth and comparatively effortless raising of the loaded shovel to hip level, substantially free of the high stresses on the back, upper body and arms that accompany the use of conventional shovels. At the top of the lift the lever arm is suitably biased to support the raised load stably in a "cradled" position, requiring minimal effort by the user, prior to disposal of the load. Where desired an additional leg may be pivotally attached to the free end of the shovel handle, and enable the hand-free tabling of the raised load. Variations of the invention are suitable for use with lifting poles and other long-handled tools.

14 Claims, 11 Drawing Sheets

LIFTING IMPLEMENT

BACKGROUND OF THE INVENTION

1. Field of the Invention

The field of the invention is devices for use with manual tools for handling materials such as snow, sand or soil, which are designed to provide a mechanical advantage in the lifting of the loaded tool.

2. Description of Problems Addressed and of Related Art

Spades, shovels and like tools are among the oldest and most common tools in human usage. However their ordinary use for the manipulation of snow, sand, soil and other materials is well known to cause serious physiological strain, which, in addition to discomfort and the necessity for a high level of muscular strength, creates significant risks of serious and chronic injury to the spine and associated musculature. In ordinary use the common snow shovel places very large loads on the muscles of the back, and necessitates highly coordinated movement while under these high loads; the dead weight of a shovelful of wet snow, possibly weighing twenty to thirty pounds and adhering to adjoining snow, is required to be lifted at arm's length, typically to hip level, while the body is bent forward and adds to the load on the back. Physiologically the spine and its associated musculature act as a cantilever, which is required to overcome the inertia of the snow mass and the weight of the torso, shoulders and head, while acting at a mechanical disadvantage, with the relative distances of load and muscular action to the center of effort operating to accentuate the required lifting effort.

Furthermore, as stated for example in U.S. Pat. No. 3,035,816 to Conant, "the greatest strain of the shoveling operation lies in imparting the initial acceleration to the lifting of the load . . . to overcome its inherent inertia with an accelerating force greater than the combined weight of the shovel and its load. This portion of the shoveling operation must be performed from a position that is not only awkward, crouched, uncomfortable and physiologically strained, but also one that involves an adverse mechanical leverage."

Notwithstanding a universal recognition that the conventional use of spades, shovels and like tools is physiologically very stressful, and causes vast numbers of disabling injuries, to date no satisfactory device has been designed that appreciably ameliorates these difficulties. The efforts of prior art workers, notably Conant, B. F. Pratt U.S. Pat. No. 3,119,596 and Evertsen U.S. Pat. No. 4,881,332 have each failed to result in a device that was effective in reducing back strain, convenient to use, and convenient to attach and detach from the primary tool.

U.S. Pat. No. 4,881,332 (Evertsen) discloses a shovel-lifting aid comprising an "elongate stem" pivotally clamped to and hanging below a shovel handle, said elongate stem having a ground-gripping foot with means to permit rotation of the stem about its own axis to facilitate unloading of the shovel head. The shovel, when loaded, is raised to hip level by drawing back and lowering the end of the handle opposite the shovel head, the ground-contacting stem acting as a fulcrum between the load and the handle. No means are provided enabling the application of foot pressure to assist the lifting action, nor means to provide lateral stability during the levered lifting action, nor any means for damping the uncontrolled swinging of the "stem" when its foot is raised above the ground. Also, the Evertsen device is not readily detachable from the primary tool.

U.S. Pat. No. 3,035,816 (Conant) discloses a hand shovel having a short and curved foot pedal pivotally fixed to the underside of the shovel head. The function of this device is directed and limited to overcoming the static inertia of the load at the outset of the lifting action. The stated objective of Conant is to provide means merely to assist the initiation of the lift, by enabling the user, with an explosive downward thrust on the foot pedal, to accelerate the upward motion of the loaded shovel head to a lifting velocity, at which point the lifting action is transferred to the upper body of the user. Accordingly no means are provided for assistance in raising the load to hip height, or any means to support or cradle the fully raised load. Lastly the mechanism disclosed in Conant is cumbersome, it is not detachable from the shovel, and it lacks means to restrain the foot pedal from swinging vigorously to and fro in the later stages of the lift.

U.S. Pat. No. 3,119,596 (Pratt) discloses a snow shovel modified to comprise, at the rear of the shovel blade, a U-shaped lever member having two parallel arms spaced by the blade and pivotally attached to its sides near its midpoint and a crossbar joining the arms at their end opposite the blade. Each arm is bent upward some 45° at or near its midpoint, forming an elbow that serves as a first fulcrum when foot pressure is applied downwardly on the crossbar of the U-shaped member, resulting in a partial raising of the loaded shovel blade. The grounded crossbar then functions as a second fulcrum for a second lifting stage, as the user draws the shovel handle towards his body, while keeping a stabilizing foot on the crossbar.

SUMMARY OF THE INVENTION

Therefore it is an object of this invention to provide an apparatus to relieve the strains on the upper body and back that result from the use of conventional shovels to remove snow, load or move soil or sand, and related commonplace uses of shovels, spades and like tools.

Another object of this invention is to provide an apparatus to relieve the strains associated with shoveling and like tasks which apparatus attaches and detaches easily from the handle or shaft of conventional shovels, spades, and other similar tools.

Another object of this invention is to provide an implement for snow shoveling, and the manual manipulation of soil, sand and other heavy materials, that combines the stable application of foot pressure and a drawing action by the upper body to provide a smooth and continuous lifting action that imposes on the upper body and back a small fraction of the physical strain associated with the use of ordinary shovels and like tools.

Another object of this invention is to provide a lifting implement that permits the user to "cradle" the fully raised and supported load comfortably at hip or waist level, virtually without strain, prior to disposing of the load.

In accordance with the invention an implement is provided that greatly reduces the physical strains associated with the use of conventional shovels, and the like, to manipulate heavy materials such as snow, soil or sand, and that also permits the assisted lifting and transport of heavy stones or other objects. Said implement includes an elongate lever arm of fixed or adjustable length, the upper end of which is removably and pivotally clamped to the shaft of a tool, such as a shovel or a lifting pole, with a hinge clamp that for example encircles the tool shaft between a V seat machined at one end of the clamp and a hose clamp threaded through the hinge clamp. The lower end of the lever arm terminates in an arcuate, two-pronged fulcrum, and a foot-engaging crossbar joining the ends of the prongs at their end.

The upper end of the lever arm is seated within and secured to the hinge clamp by an axis pin, allowing the lever arm to be pivoted downward from a storage position, approximately parallel to and adjoining the tool shaft, to a fully open position somewhat past the perpendicular. In one embodiment of the invention a strong spring in the body of the hinge clamp biases a plate against the upper end of the lever arm, and thereby selectively biases the lever arm in each of the two limit positions, a closed or storage position in which the lever arm rests stably adjacent and parallel to the tool shaft, and a fully open position in which the lever arm, its base grounded in the course of the lifting action, has pivoted slightly beyond a position perpendicular to the tool shaft, and forms a stable support for effortlessly cradling the loaded shovel or lifting pole at approximately hip or waist level.

Optionally a retractor arm may be pivotally attached at one end to the upper part of the lever arm and at its other end to a sleeved handle encircling the portion of the tool shaft opposite the load, enabling the user to pivot the lever arm to a closed position alongside the tool shaft when the load has been raised, and prior to throwing the load aside or transporting it.

The apparatus of the invention is operated by first withdrawing the lever arm from its closed or storage position and allowing it to hang below the shovel handle or pole, the curved base of the lever arm facing toward the user, and contacting the ground, as the material to be lifted is approached. Where the tool employed is a spade or snow shovel, the blade of the shovel is loaded by the user in the usual manner, by thrusting the blade of the shovel into the snow or other material to be manipulated. To initiate the lifting action the user stands substantially upright and with one foot presses down with his weight on the foot-engaging crossbar, while simultaneously drawing the handle or shaft of the shovel back towards his body. The combined effect of these actions is to raise the loaded shovel effortlessly in a controlled arc upwards and towards the user, to approximately hip level. As it approaches the top of the lifting arc the load passes vertically over and slightly past the fulcrum defined by the ground contact points of the curved base of the lever arm, and settles into a secure and fully supported resting position, at which it may be "cradled" indefinitely with virtually no effort, carried away, or emptied in the usual manner. The user's body remains substantially upright throughout the lifting operation. A similar lifting action is employed when the apparatus of the invention is employed in conjunction with a lifting pole having a hook or other means for bearing a suspended load, as could be used for example to raise and transport heavy stones in the repair of stone walls.

In contrast to prior art devices the lifting aid of the present invention provides a large mechanical advantage throughout the lifting operation, beginning with the necessity to overcome the inertia of the load at rest on the ground and continuing until the load has been raised to approximately hip level, and has settled into the "cradled" position in which it may be effortlessly supported indefinitely.

BRIEF DESCRIPTION OF THE DRAWINGS

In the drawings, which represent the best mode presently contemplated for carrying out the invention.

DESCRIPTION OF ILLUSTRATED EMBODIMENTS

Figure 2:
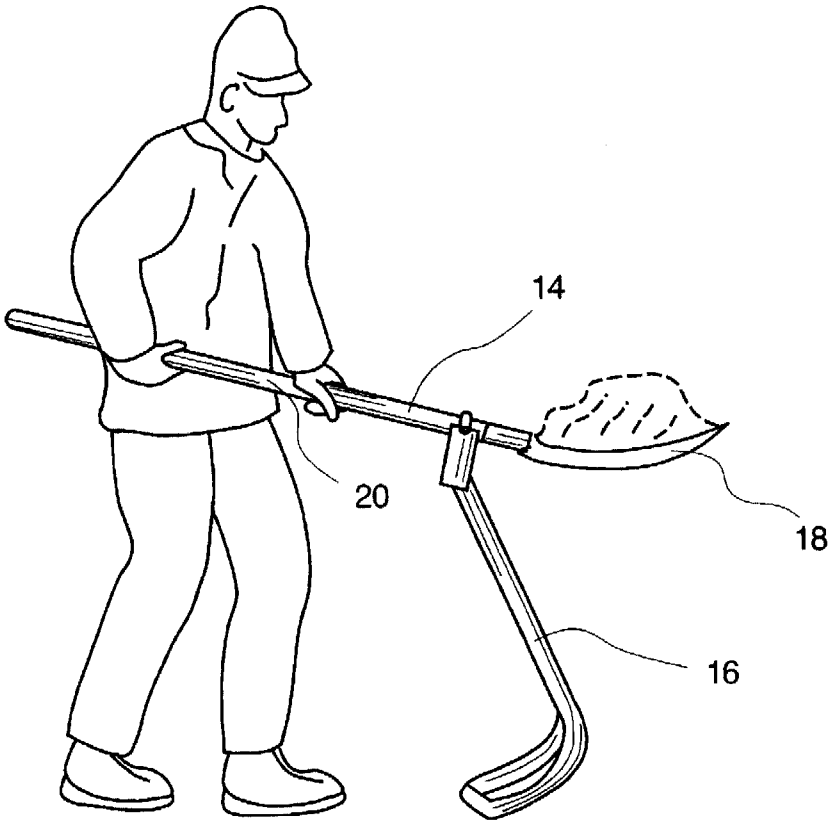
Figure 1:
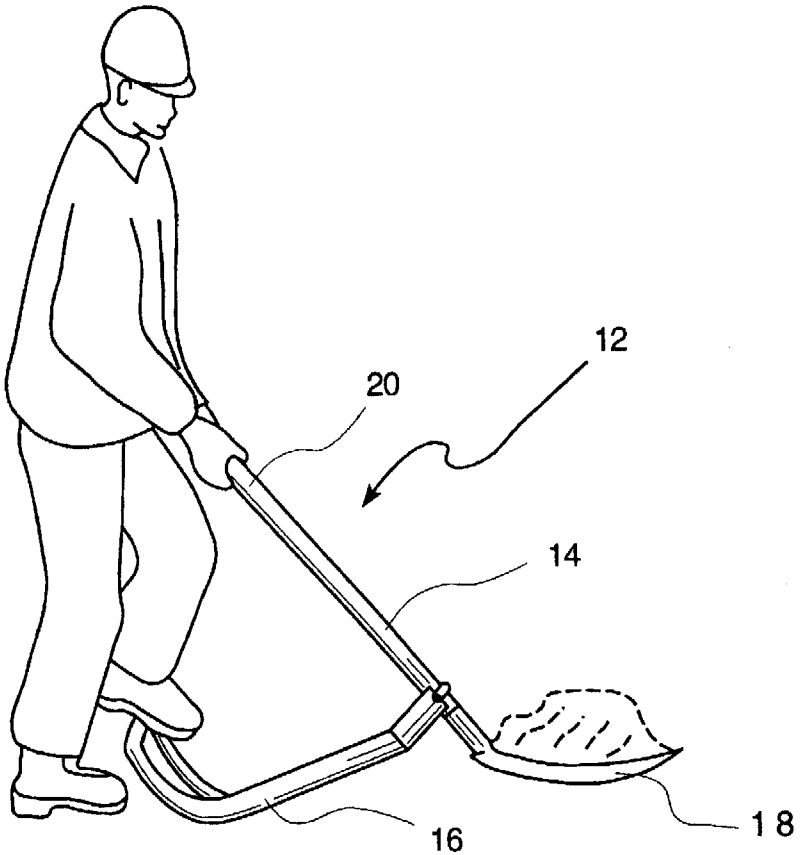
FIG. 1 is an elevation view of a lifting aid apparatus in accordance with the invention, shown in use by a shoveler preparing to initiate a lift, FIG. 2 another elevation view of the lifting aid apparatus of FIG. 1 shown in use by a shoveler at the conclusion of the lifting action, FIG. 3 a view of the lifting aid apparatus of FIGS. 1–2 taken along the line 3—3 thereof, and drawn to a larger scale, in the fully open position, FIG. 4 a view of the lifting aid apparatus of FIG. 3 in the closed or storage position, taken along line 4—4 thereof, FIG. 5 a view of a portion of the lifting aid apparatus of FIGS. 1–4, showing a hinge clamp embodiment of the tool shaft attachment means, FIG. 6 a view of a variant of the portion of the lifting aid apparatus of FIGS. 1–4, including an optional retractor arm, taken along line 6—6 thereof, FIG. 7 a view of the lifting aid apparatus of FIG. 6, shown in the closed position, FIG. 8 an elevation view of an alternate embodiment of a lifting aid in accordance with the present invention, shown in the open position, FIG. 9 a view of the lifting aid of FIG. 8, taken along line 9—9 thereof, in the closed position, FIG. 10 a view of a portion of the lifting aid apparatus of FIGS. 8–9, showing an embodiment of the tool shaft attachment means, FIG. 11 a view of a variant of the lifting aid apparatus of FIGS. 8–9 further comprising gas cylinder means, FIG. 12 a view of the lifting aid apparatus of FIGS. 8–9 further comprising a tabling leg.
Figure 3:
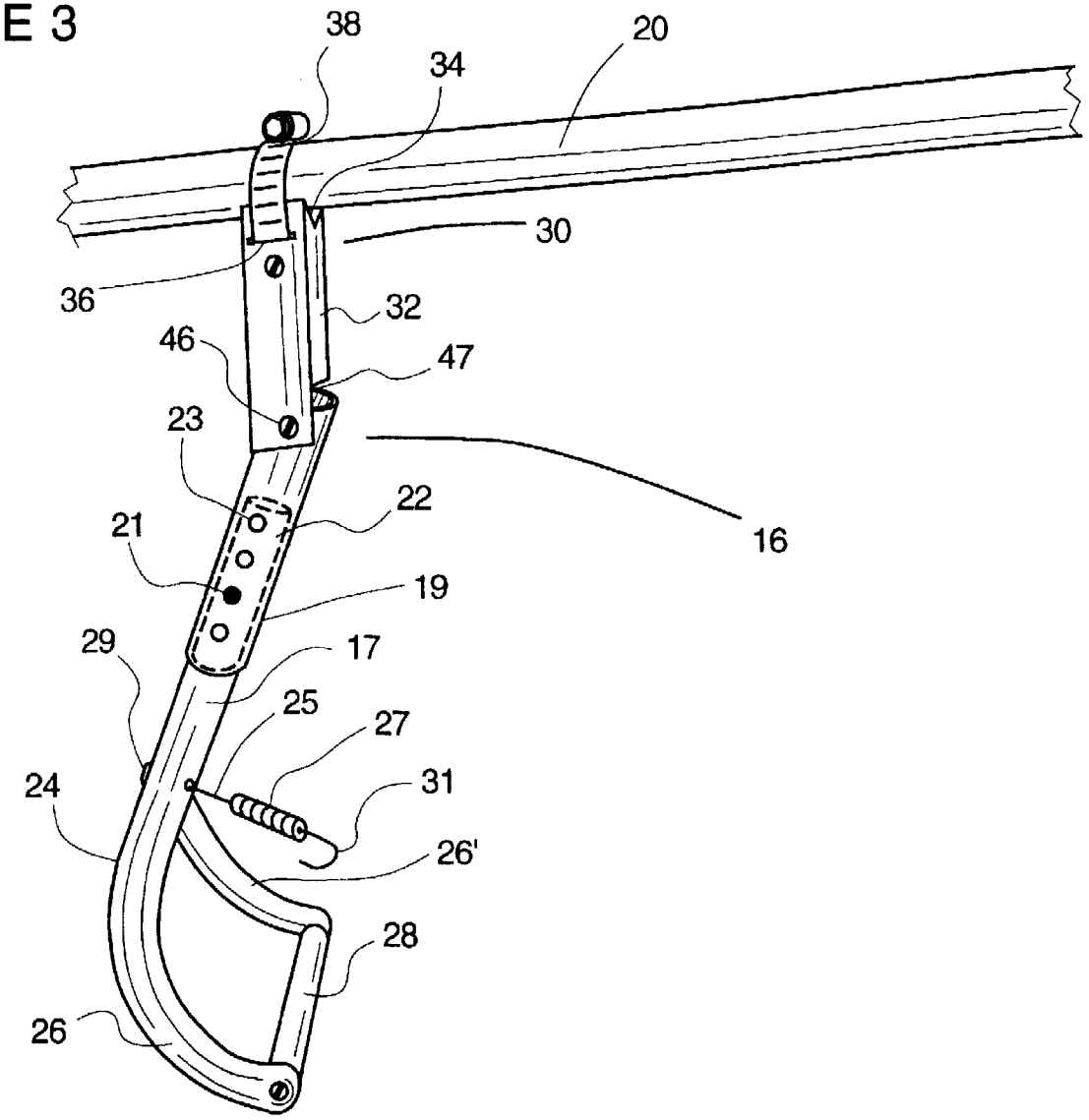

Referring in detail to the drawings, in FIGS. 1 and 2 there is shown in use a snow removal implement 12 comprising a conventional snow shovel 14, having a blade 18 and a handle or shaft 20, and an attachment 16 according to the invention, said attachment 16 being shown in greater detail in FIG. 3. Attachment 16 is preferably manufactured principally of a strong and lightweight material such as aluminum, EMT tubing, ABS plastic and the like, and it comprises as shown in FIG. 3 an elongate lever arm 22 of fixed or adjustable length that terminates in a dual member curved fulcrum 24 having prongs 26 and 26' joined at their distal end by cross member 28. The curvature of prongs 26 and 26' as shown is in the order of 90° with a radius of about 6 inches but is susceptible of other suitable radii and curvatures including cam-shaped curves. Alternatively the curved member fulcrum 24 may comprise additional prongs intermediate prongs 26 and 26' or it may be constructed as a curved plane having a solid, ribbed or honeycomb surface.

To securely and removably attach the attachment 16 to the handle or shaft 20 of a conventional snow shovel or like tool there is provided at the top end of lever arm 22 a hinge clamp 30 having a hollow body 32, a machined V seat 34 for receiving the tool shaft (which may alternatively be machined to the contours of the handle or shaft of a specific type of shovel or tool), opposing slots 36 and 36' located below the V seat 34 through which slots there is threaded a suitably sized hose clamp 38 (or similar clamp) which encircles both V seat 34 of the hinge clamp and the handle of the snow shovel or other attached load carrying device which sits within it, thereby securely and removably clamping together the conventional shovel and the attachment of the invention. Alternatively, said machined V seat (or seat machined to the contours of the attached shaft), may be machined such that the attached shaft sits deep into the seat, and a pin, rivet, or similar device fitted through both the hinge clamp and the shaft, thereby locking the two together.

Lever arm 22 is preferably adjustable in length, for example as shown in FIG. 3 comprising telescoping tube elements 17 and 19 adjustably joined by spring release clip 21 on interior tube 17 fitting apertures 23 on the surface of exterior tube 19. For storage purposes lifting aid 16 is provided with a tie 25 comprising a short length of elasticized cord 27 secured to capped rod 29 passed through the tubing of lever arm 22, said cord having a hook 31 at its free end for hooking around tool shaft 20 and thereby securing the lever arm in the storage position, as shown for example in FIG. 4.

Figure 5:
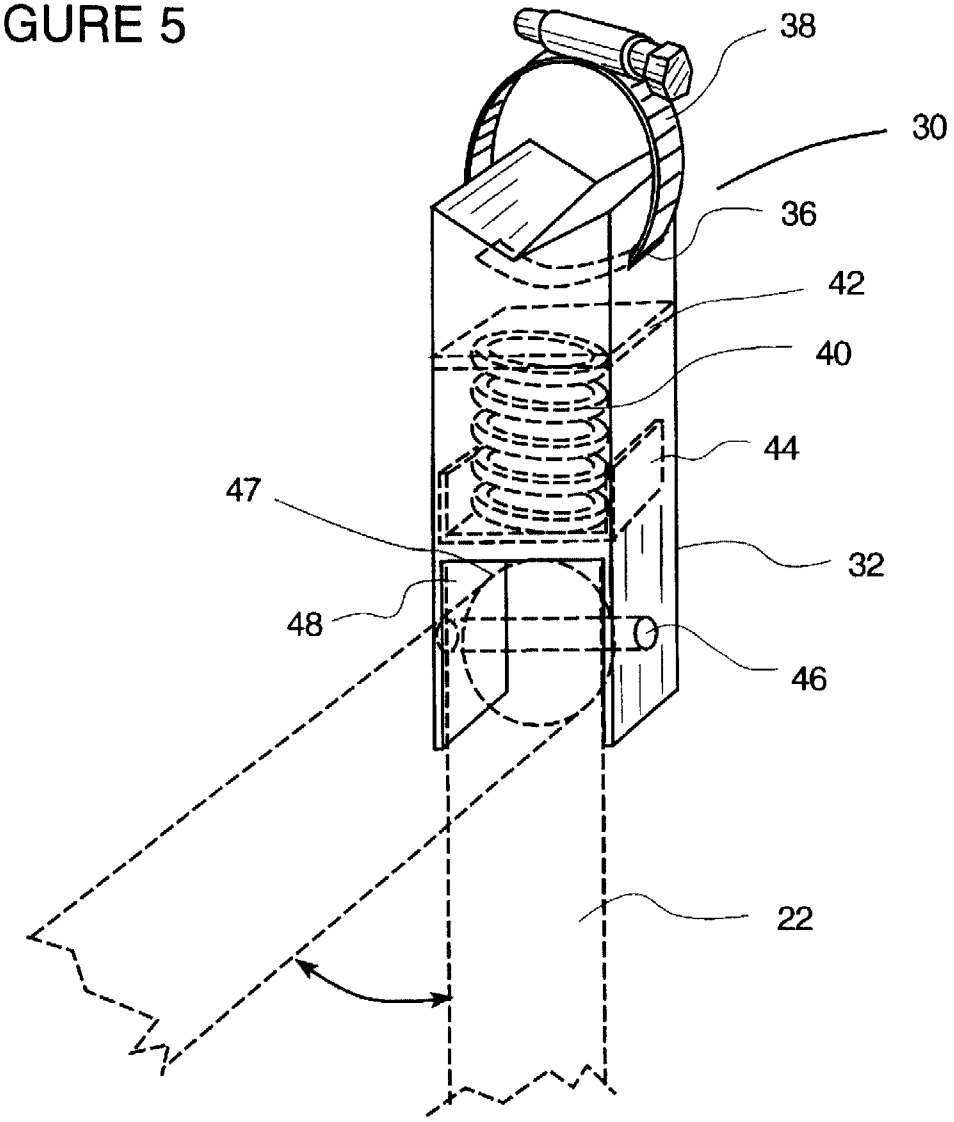

As shown in detail in FIG. 5, internally the body 32 of hinge clamp 30 contains an appropriately gauged compression spring 40, held in place by a fixed retainer 42 at the end of spring 40 closest to the V seat 34 of hinge clamp 30, and at its other end within free floating, U-shaped plate 44, biasing plate 44 against the singular end 46 of lever arm 22, whereby plate 44 rides in constant contact and tension against said singular end 46 of lever arm 22 as lever arm 22 is rotated through a circumscribed arc in the course of load lifting operations.

Figure 4:
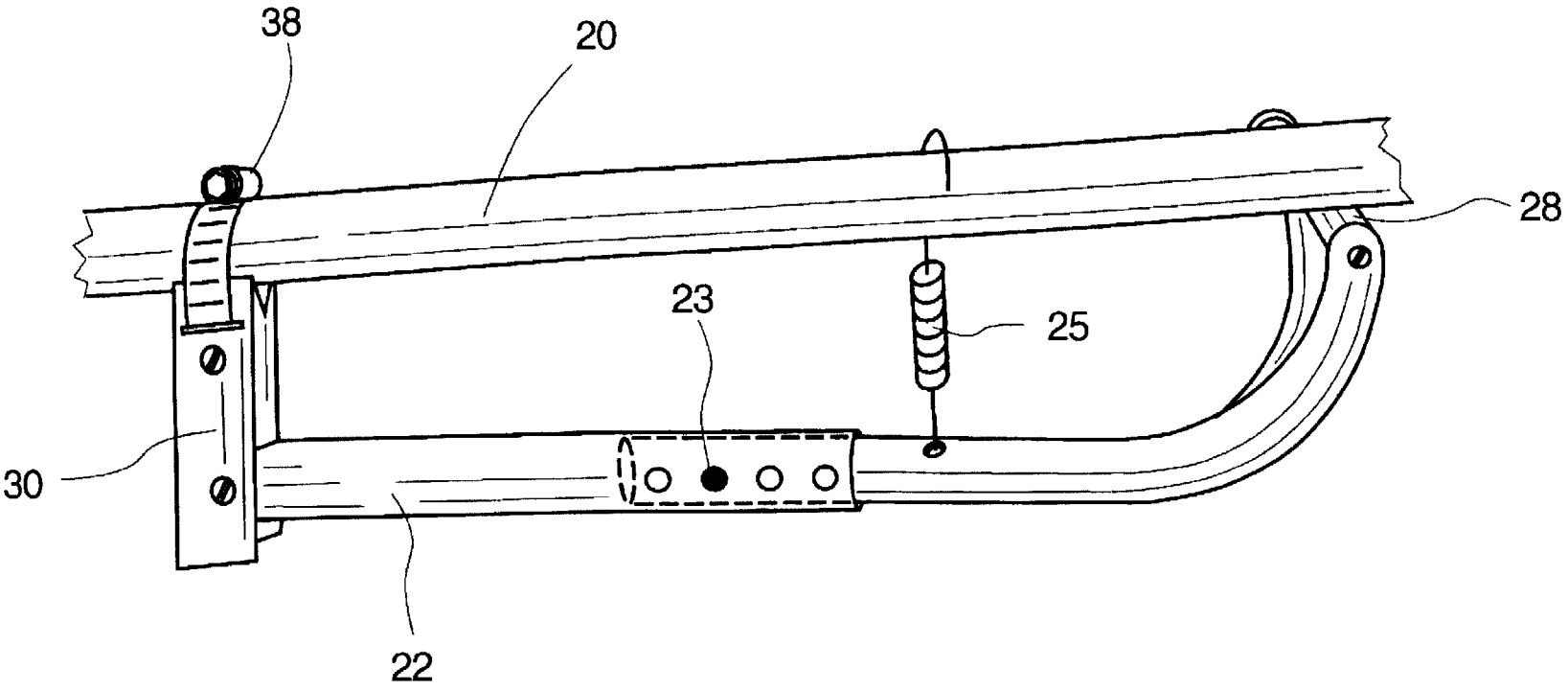

Lever arm 22 is pivotally secured to hinge clamp 30 by axis pin 46 positioned at or near the centerline of hinge clamp body 32 and at right angle to the axis of V seat 34. Cutout 48 in the body 32 of hinge clamp 30 permits lever arm 22 to pivot in a circumscribed arc between a closed position, as shown in FIG. 4, with the lever arm extending through cutout 48 to a position parallel to and adjoining the shaft 20 of shovel or like tool 14, and a fully open position as shown in FIG. 3 in which lever arm 22 has rotated slightly more than 90° and is held from further rotation by the rear interior surface 50 of the body 32 of hinge clamp 30. Cutout 48 is profiled suitably to retain spring 40 and free floating plate 44 within hinge clamp body 32 as the end 46 of lever arm 22 rides the surface of plate 44 in response to the pivoting of lever arm 22.

Contacting face 47 at singular end of lever arm 22 which rides in constant contact and tension against the free-floating plate 44, may be cut square and perpendicular to the plane of the lever arm. Alternatively contacting face 47 may be provided with a slight angle relative to the plane of the lever arm, it may be gradually rounded, or it may be ramped at both its leading and trailing edges with a flat spot in the middle; it will be apparent to persons skilled in the mechanical arts that each such variation will in turn effect a slight variation in the spring-biased angle formed by the tool shaft 20 relative to the lever arm 22 when the lever arm is in the fully open position at the conclusion of the lifting operation, and thus in the cradle-like effect obtained at the fully opened and retained position.

As lever arm 22 is rotated from the open position shown in FIG. 3 towards and near the closed or storage position shown in FIG. 4, plate 44 as biased against the tip of lever arm 22 by spring 40 exerts a strong cam-like effect against the upper portion surface of lever arm 22 sufficient to retain the lever arm in the closed position without "free-wheeling."

Numerous variations on the detailed design of hinge clamp 30 are of course possible, for example locating V seat 34 of hinge clamp 30 along the length of hinge clamp body 32, instead of at an end thereof.

Figure 6:
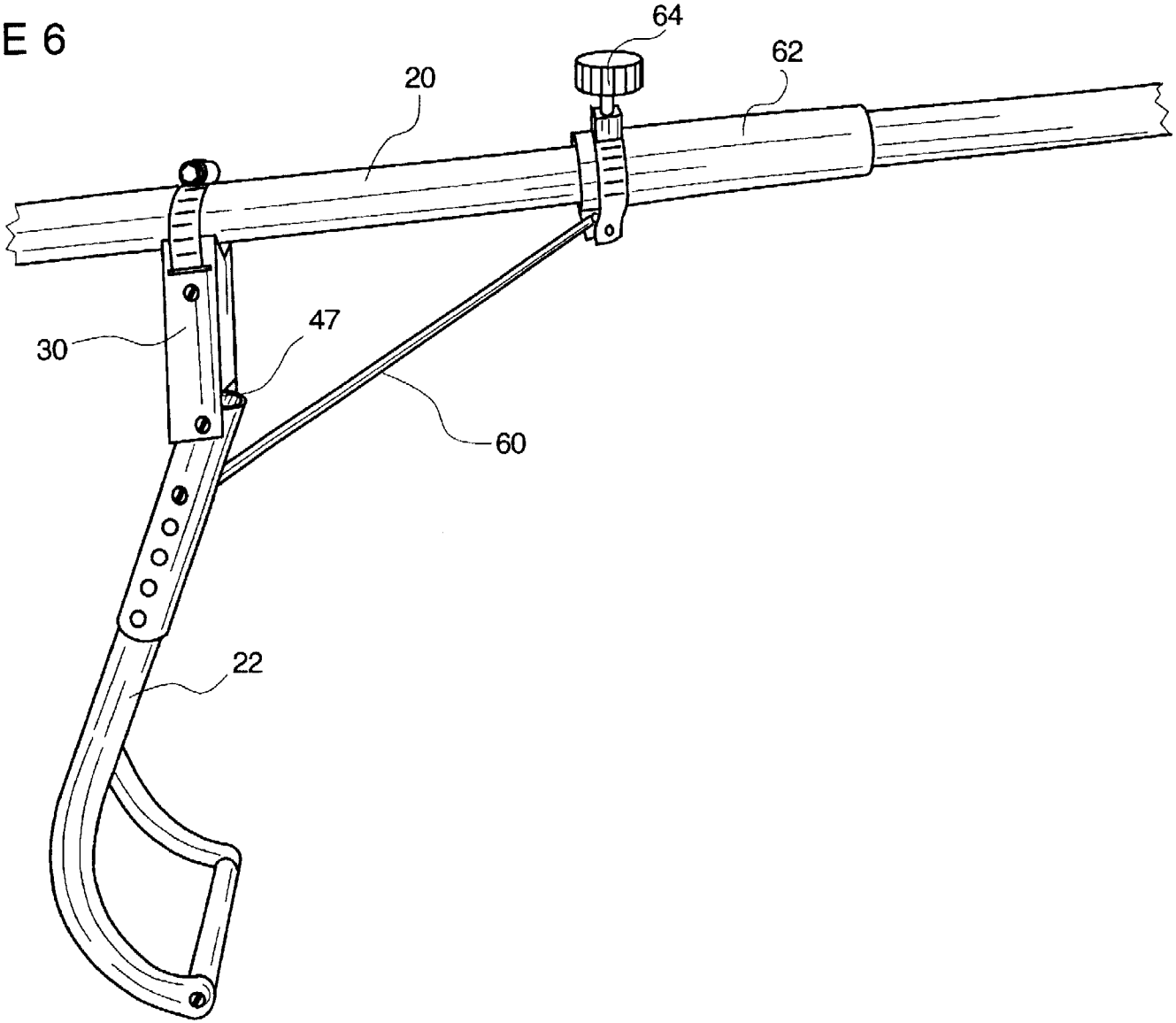
Figure 7:
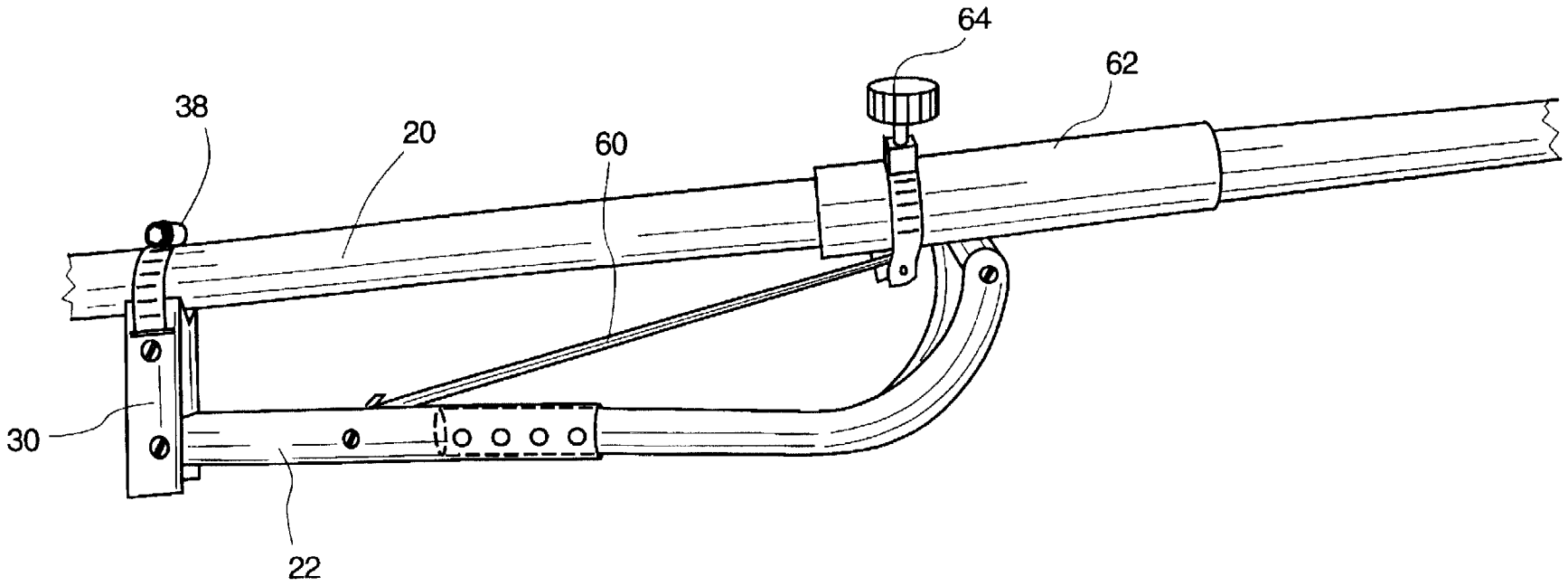

In one preferred embodiment of the invention, shown in FIGS. 6 and 7, the lifting aid is provided with a retractor arm 60 pivotally attached at one end to lever arm 22 at a point intermediate the midpoint and the upper end 47 of lever arm 22 and pivotally attached at its other end to sleeved handle 62 that encircles tool shaft 20. Sleeved handle 62 may be provided with a handled set screw 64 or the like, threaded through an opening in sleeved handle 62 and permitting the position of sleeved handle 62 on the tool shaft to be releasably locked at any position within its range of motion, between a closed or "storage" position and a fully open position.

In operating the lifting implement of the present invention when equipped with a lever arm retractor assembly, the user in addressing the load to be raised initially places his rearward hand on and near the free end of tool shaft 20, in the conventional manner, and raises the load in the manner described above to a cradled position. At this point the user optionally may move his rearward hand to grasp sleeved handle 62, and, either prior to or in the course of throwing the load, by pulling said rearward hand towards his body cause retractor arm 60 to draw lever arm 22 alongside tool shaft 20 to the position shown in FIG. 7. This action minimizes the profile of lever arm 22 as an encumberment during the load throwing action. To initiate the next shoveling operation, and as shovel blade 18 is being positioned for loading, the user with the rear hand slides sleeved handle 62 downward along tool shaft 20, causing lever arm 22 to rotate downward to the ground and into position to assist the next lift. The user then returns his rear hand to tool shaft 20 at a point near the free end of said shaft.

Optionally the lever arm retractor assembly may be employed simply when storing the tool with the lifting aid secured to it, to draw the lever arm into a closed or storage position alongside the tool shaft.

Where the lifting aid of the present invention is provided as a detachable implement suitable for attachment to the handle or shaft of a conventional shovel, spade or other long-handled tool, and it comprises a lever arm retractor assembly, its mounting to the tool shaft is easily effected by first inserting the free end of the tool shaft 20 through the sleeved handle 62 of the lever arm retractor assembly, then securing hinge clamp 30 to said tool shaft.

Figure 8:
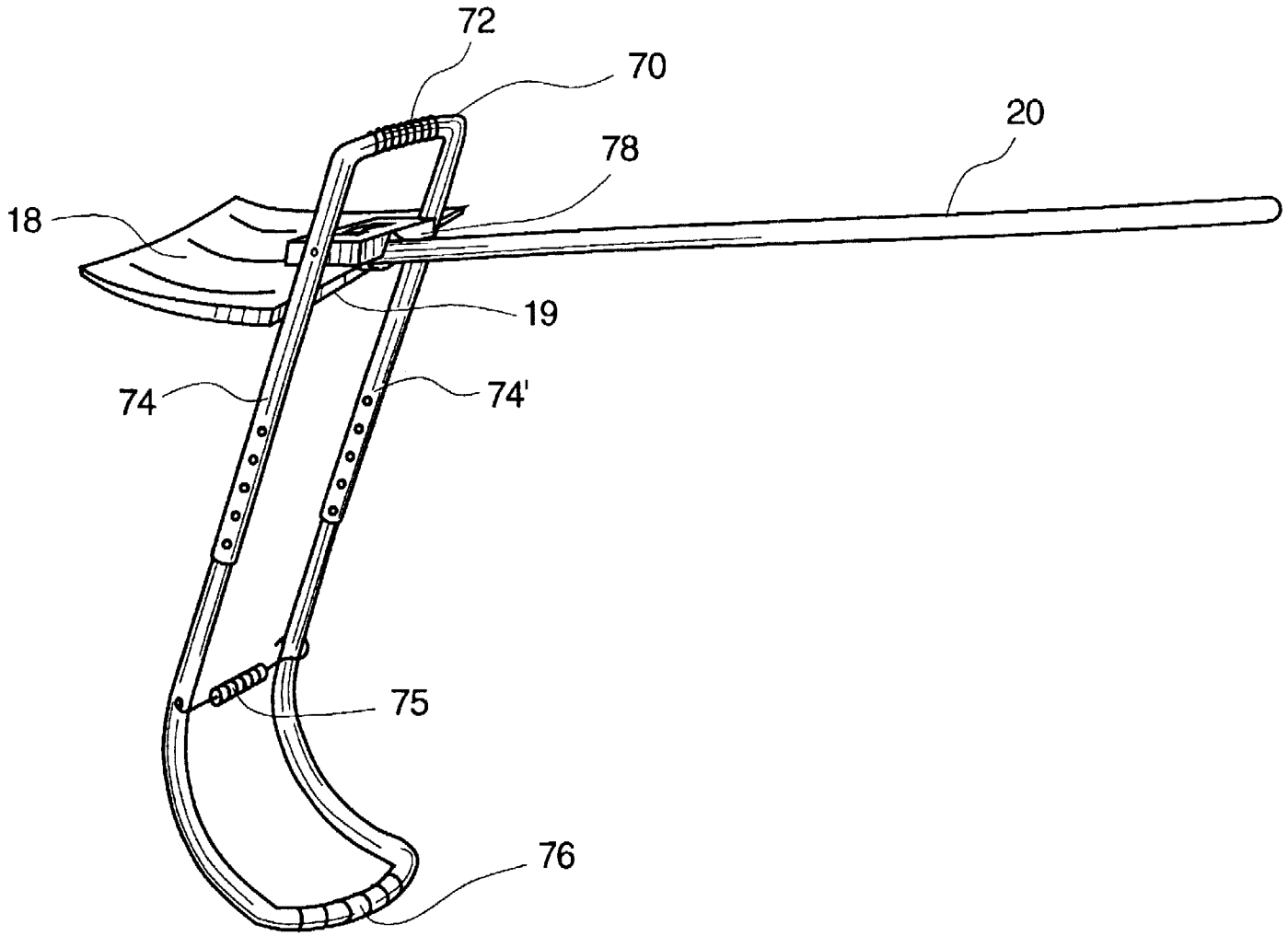

FIG. 8 illustrates another embodiment of the invention with a particularly simple and economical design. Resembling a rectangular or trapezoidal frame bent 90° at one end, this embodiment comprises an upper cross-member 70, preferably encircled by textured handgrip 72, lever arms 74 and 74' depending from each end of cross-member 70 and bent approximately 90° near their lower end, and foot-engaging cross-bar 76 joining said lever arms at their lower end. Near the upper end of lever arms 74 and 74' cross-piece 78 (shown in detail in FIG. 10) is disposed between and rotatably secured to said lever arms by any suitable means, and comprises means for detachably clamping the lifting device to shaft 20 of a snow shovel or like tool. Elasticized cord 75 is employed to bias tool shaft 20 against foot-engaging cross-bar 76 during storage of the tool.

Figure 9:
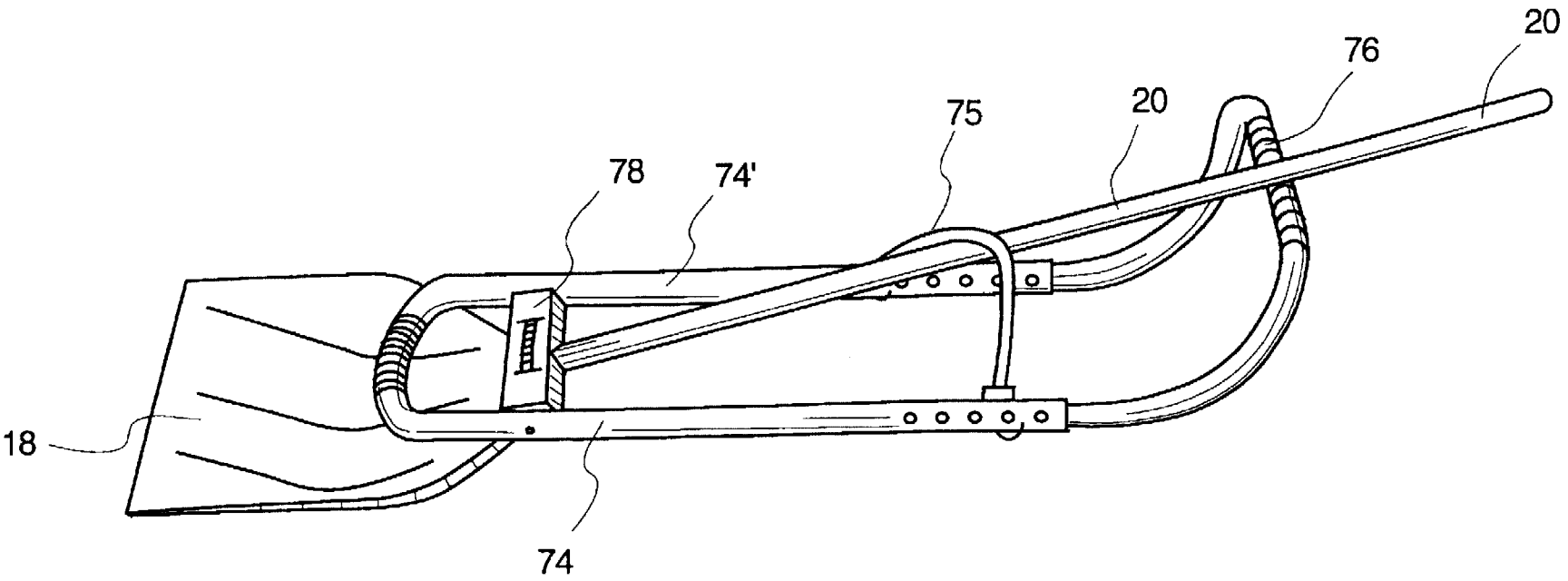
Figure 10:
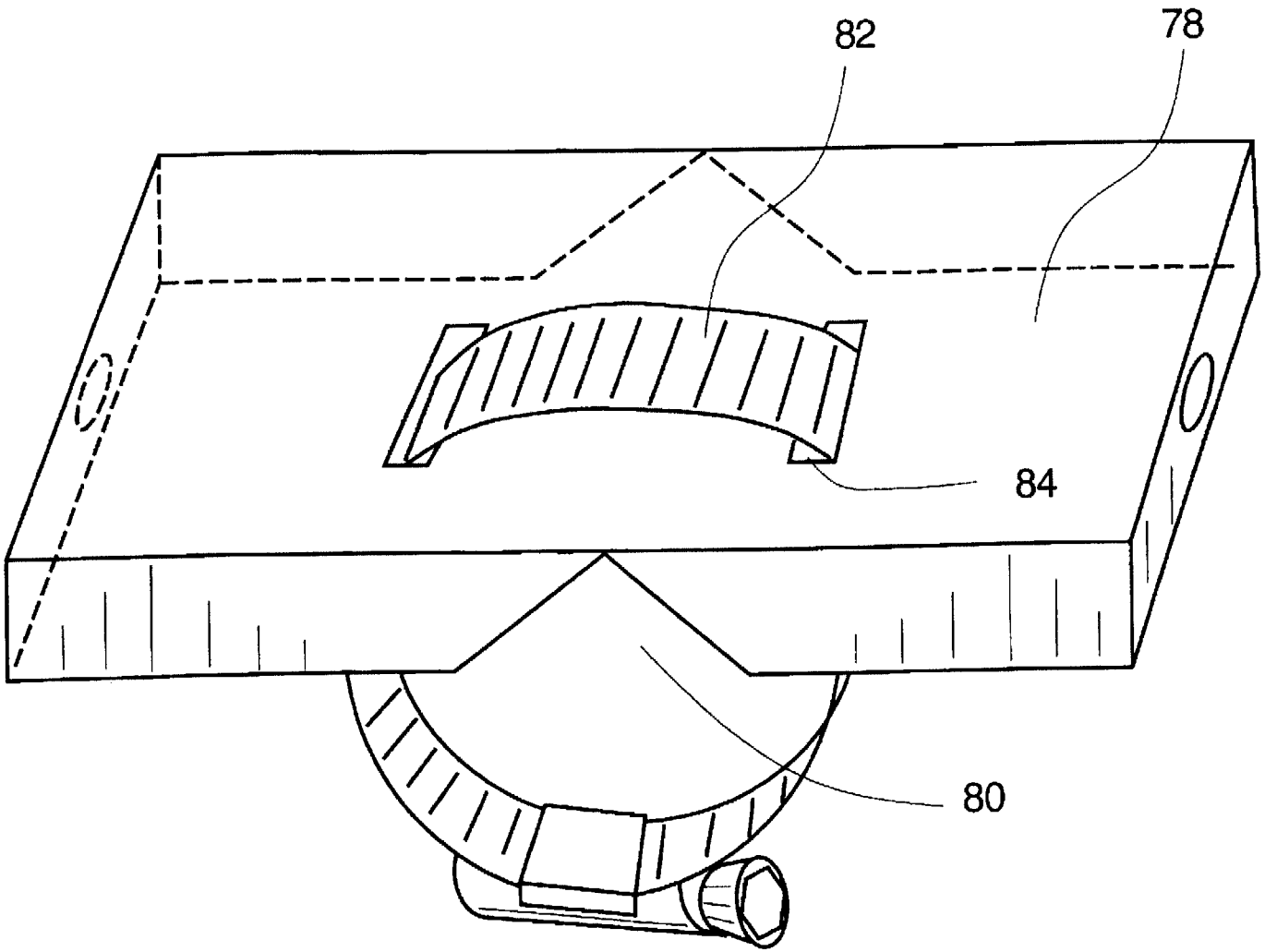

In the embodiment shown in FIGS. 8–9, as shown in FIG. 10, cross-piece 78 has been manufactured from U stock shaped to form an open rectangular box, the end faces of which are apertured to receive retaining bolts. V shaped cuts 80 on facing walls of cross-piece 78 form a V block for receiving the shovel or other tool shaft, which may be firmly secured to said V block by hose clamp 82 threaded through slots 84 in the floor of cross-piece 78 that span said V block. Preferably the distance separating arms 74 and 74' is less, at some point between cross-member 70 and cross-piece 78, than the width of rear edge 19 of shovel blade 18, whereby said blade edge 19 acts as a stop to arms 74 and 74' pivoting beyond a suitable load cradling position, thereby enabling stable cradling of the raised load with little or no effort by the user. In the use of this embodiment, the user having raised the load to the cradling position may transfer his forward hand to textured handgrip 72 on cross-member 70 prior to throwing or transporting the load; this action provides a laterally stable carrying position and also it prevents any "free wheeling" of the lifting device during transport or disposal of the raised load.

Figure 11:
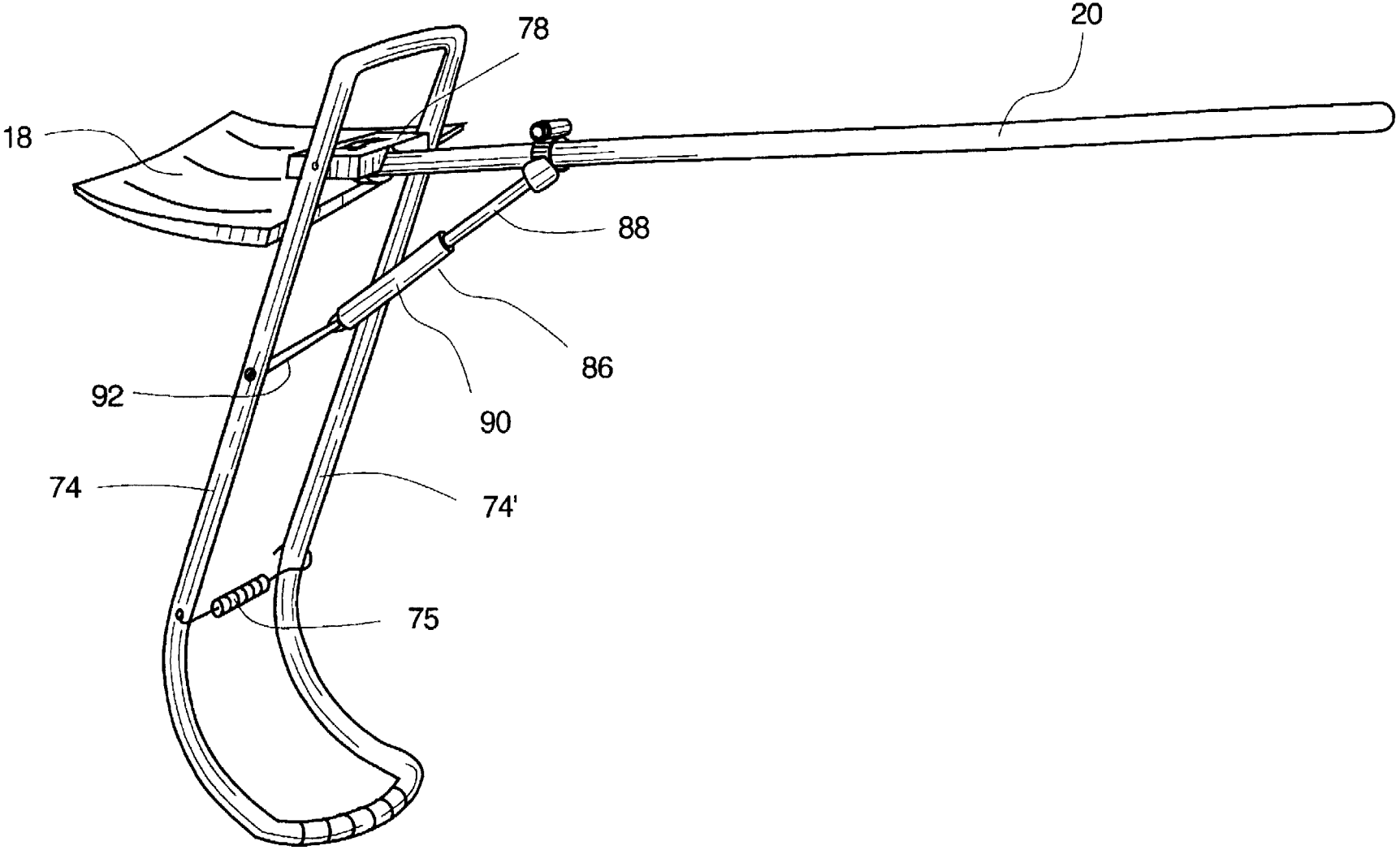

A variant of the preceding embodiment is illustrated in FIG. 11. This embodiment is provided with a conventional self-contained gas cylinder 86, having a piston 88 pivotally attached to tool shaft 20 by any suitable means, and a gas-containing cylinder 90 similarly attached pivotally to cylinder cross-piece 92 disposed between lever arms 74 and 74', beneath cross-piece 78 to which tool shaft 20 is secured. Gas cylinder 86 provides a releasable cradled locking effect at its fully open position without "free wheeling", while its closed position, approximately parallel to tool shaft 20, can be maintained for storage purposes by means of elasticized cord 75 or the like. An air cylinder, spring actuated mechanism or similar device may be used in lieu of gas cylinder 86.

It will be observed that in yet another variant of the embodiments illustrated in FIGS. 8–11, tool shaft 20 may be pivotally secured to top cross-member 70, by replacement of textured handgrip 72 with suitable shaft attachment means, and cross-piece 78 dispensed with.

Figure 12:
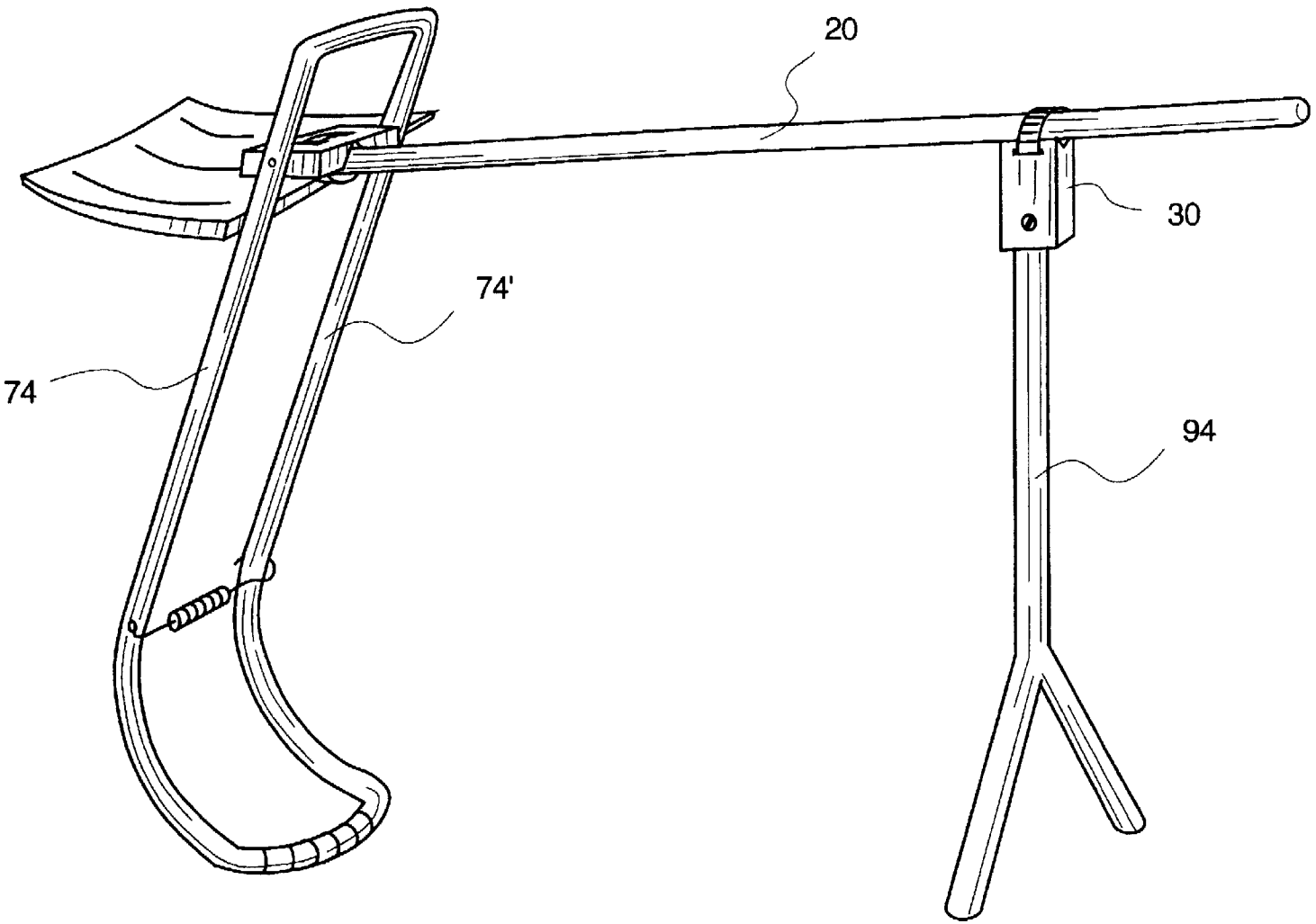

As illustrated in FIG. 12 all of the described embodiments of the present invention may additionally be provided with a detachable leg 94, approximately the length of lever arms 22 or 74, to be hingeably and detachably secured to tool shaft 20 at a point near the free end of said shaft 20, to enable the hands-free "tabling" of the raised load. Leg 94 generally resembles lever arm 22 shown in FIGS. 3–4 and comprises a longitudinal member that terminates at one end in a fork and at its other end is detachably secured to tool shaft 20, for example by means of a hinge clamp such as spring-biased hinge clamp 30 shown in FIG. 5, that enables leg 94 to pivot between releasably locked open and closed positions. Of course leg 94 may take other suitable forms. When a load has been raised and cradled as described above, the opening of additional leg 94 creates a second stable base for supporting the raised load, and enables the load effectively to be tabled between lever arms 22 in the embodiments of FIGS. 3–4 (or lever arms 72 in the embodiments of FIGS. 8–9) and leg 94, entirely free of support by the user.

It will be readily apparent to those of skill in the mechanical arts that the lifting aid of the present invention can easily be manufactured integral to a unit such as a shovel, lifting pole, or other similarly handled or shafted product, or alternatively as an easily attachable and detachable add-on device. Furthermore the lifting aid of the present invention can readily be adapted by those of skill in the mechanical arts to such applications as the lifting, carrying or transport of any heavy or bulk substance such as snow, dirt, packages, stones, and construction materials, and may for certain applications be manufactured in dimensions substantially smaller or larger than is suitable for the specific applications referred to herein.

It is therefore to be understood that the scope of the present invention is not necessarily limited to its detailed description and illustration herein, and that many other modifications can be made in the disclosed apparatus without departing from the invention. Therefore it is the intent of the appended claims to cover all such variations and modifications as come within the true spirit and scope of the invention.

What is claimed is:

1. A lifting tool comprising:

a) a shaft, b) load-bearing means secured to one end of the shaft, c) a lever arm having an upper end and a lower end and extending downward from the shaft to the vicinity of the ground when said load-bearing means rests on the ground and the free end of the shaft is approximately waist-high, the lower end of said lever arm terminating in an arcuate ground-contacting fulcrum spanned by a foot-engaging means positioned on the side of said ground-contacting fulcrum opposite the upper end of said lever arm, and d) means for pivotally attaching the upper end of the lever arm to the shaft at a point between the midpoint of the shaft and the load-bearing means.

2. The lifting tool of claim 1 wherein the means for pivotally attaching the lever arm to the shaft comprises:

a) means for receiving and securely clamping the shaft, b) means for receiving and pivotally securing the upper end of the lever arm, c) two-position biasing means for releasably retaining the lever arm selectively at a storage first position approximately parallel to and adjoining the shaft and at a cradling second position whereby the lever arm has pivoted approximately to or past the vertical when the shaft is horizontal.

3. The lifting tool of claim 1 further comprising a retractor arm, said retractor arm having one end pivotally attached to the lever arm and its other end pivotally attached to a sleeved handle, said sleeved handle being adapted to encircle the shaft between the end of the shaft opposite the load-bearing means and the point at which the lever arm is attached to the shaft.

4. The lifting tool of claim 1 wherein the shaft and the load-bearing means are respectively the handle and the blade of a conventional snow shovel.

5. The lifting tool of claim 1 further comprising a leg pivotally attached to the shaft at a point proximate the end of the shaft opposite the load-bearing means, and adapted to permit tabling of a raised load between said leg and the lever arm.

6. The lifting tool of claim 3 wherein the arcuate fulcrum comprises a plurality of curved prongs.

7. The lifting tool of claim 1 wherein the arcuate fulcrum comprises a solid surface.

8. The lifting tool of claim 1 wherein the load-bearing means is adapted to bear a load suspended below the load-bearing means.

9. A lifting aid for attachment to the shaft of a shovel, spade or like tool having load-bearing means at one end of the shaft, said lifting aid comprising:

a) a frame including a cross-member disposed between two legs, said legs each bent approximately 90° near their lower end to form collectively an arcuate ground-contacting fulcrum, and a foot-engaging cross-bar, positioned on the side of said ground-contacting fulcrum opposite said cross-member, spanning and joining the legs at their lower end, and b) means for pivotally securing said shaft to said cross-member.

10. The lifting aid of claim 9 further comprising a cross-piece disposed between and attached to said legs at a point below the cross-member, and a self-contained gas cylinder pivotally attached at one end to said cross-piece and at its other end to said shaft.

11. The lifting aid of claim 9 further comprising an additional leg, said additional leg having at one end attachment means for pivotally attaching said additional leg to a tool shaft at a point proximate the end of said shaft opposite the load-bearing means of the tool, and adapted to permit the tabling of a raised load between said additional leg and the legs of the frame.

12. A lifting aid for attachment to the shaft of a shovel, spade or like tool having a load-bearing surface at one end of the shaft, said lifting aid comprising:

a) a frame having a first cross-member, b) legs extending downward from the first cross-member, the lower part of each of said legs being bent approximately 90° to form collectively an arcuate ground-contacting fulcrum and being spanned and joined at their lower end by a foot-engaging cross-bar positioned on the side of said ground-contacting fulcrum opposite said first cross-member, c) a second cross-member disposed between and rotatably attached to said legs intermediate the first cross-member and the ground-contacting fulcrum, d) said second cross-member comprising means for attaching said frame to the shaft of a tool.

13. The lifting aid of claim 12 wherein the distance separating the legs is less, in the space between the first cross-member and the second cross-member, than the width of the tool load-bearing surface, whereby said legs operate as a stop to prevent further pivoting of the load-bearing surface relative to the legs as a load-cradling position is reached.

14. The lifting aid of claim 12 further comprising an additional leg, said additional leg having at one end attachment means for pivotally attaching said additional leg to a tool shaft at a point proximate the end of said shaft opposite the load-bearing surface of the tool, and adapted to permit the tabling of a raised load between said additional leg and the legs appended to the first cross-member.

* * * * *